US008579081B2

(12) United States Patent
Richey et al.

(10) Patent No.: US 8,579,081 B2
(45) Date of Patent: Nov. 12, 2013

(54) REMOTE CONTROLLED OVERHEAD LADDER SYSTEM

(75) Inventors: Steven M. Richey, Morristown, TN (US); Roy G. Parton, Pigeon Forge, TN (US)

(73) Assignee: Precision Ladders, LLC, Morristown, TN (US)

( * ) Notice: Subject to any disclaimer, the term of this patent is extended or adjusted under 35 U.S.C. 154(b) by 357 days.

(21) Appl. No.: 13/020,931

(22) Filed: Feb. 4, 2011

(65) Prior Publication Data

US 2012/0199417 A1 Aug. 9, 2012

(51) Int. Cl.
*E06C 9/12* (2006.01)

(52) U.S. Cl.
USPC ..... 182/77

(58) Field of Classification Search
USPC ..... 182/77, 78, 79, 80, 81
See application file for complete search history.

(56) References Cited

U.S. PATENT DOCUMENTS 4,541,508 A * 9/1985 Lundh ..... 182/78
5,407,261 A * 4/1995 Mercer ..... 312/248
6,866,118 B1 3/2005 Battenberg
6,886,661 B1 5/2005 Battenberg
7,587,866 B1 * 9/2009 Perkins ..... 52/183
2007/0034450 A1 2/2007 Richey
2008/0060874 A1 3/2008 Lair

FOREIGN PATENT DOCUMENTS

JP 05256078 A * 10/1993 ..... E06C 9/12

* cited by examiner

*Primary Examiner* — James O Hansen
*Assistant Examiner* — Kristine Florio
(74) *Attorney, Agent, or Firm* — Pitts & Lake, P.C.

(57) ABSTRACT

A remote controlled overhead ladder system including a ladder structure having at least a first section and a second section. The ladder structure can be mounted to a support structure located above an opening of the overhead surface, and can include a remote controlled lifting cable connected to the first and second sections such that upon receipt of a remote control signal, the lifting cable pivots the second section toward a front surface of the first section until the second section is oriented adjacent to the front surface of the first section, at which time the lifting cable pivots the first section and the adjacent second section as a group toward the overhead surface until the ladder sections are contained above the overhead surface.

4 Claims, 6 Drawing Sheets

REMOTE CONTROLLED OVERHEAD LADDER SYSTEM

BACKGROUND

1. Field of Inventive Concept

The present general inventive concept relates generally to folding overhead ladders, and more particularly, to a sectional overhead ladder capable of automatic operation with the assistance of a remote controlled motorized apparatus.

2. Description of the Related Art

Overhead ladders are commonly used to provide convenient, temporary access to attics of houses or other structures without the loss of floor space occupied by a permanent stairwell. Typically, overhead ladders include a plurality of sections that are folded upon one another within a frame secured to a structure. The ladder typically includes hinges for connecting the sections. The sections of the ladder align during use to form a continuous ladder structure spanning from one surface to another.

An overhead ladder is typically accessible through an opening in a ceiling by way of a hatch or panel mounted in the ceiling. Most commonly, a user must access such an overhead ladder by pulling down the ceiling-mounted hatch and manually extending the sections of the ladder. However, these sections are often heavy and cumbersome to operate.

Some existing overhead ladders have been developed such that the stair portion is extended and retracted by some type of powered arrangement. However, most existing systems are not entirely satisfactory in providing a remote controlled overhead ladder system capable of folding, unfolding, opening, and closing a sectional overhead ladder to provide access to an attic area or other elevated structure.

SUMMARY

The present general inventive concept provides a remote controlled motorized sectional overhead ladder for use in attics or other elevated or lofted structures. In some example embodiments, the overhead ladder system is capable of remotely opening, closing, folding, and unfolding in response to a remote signal from a remote control device. In some embodiments, after a first section of the ladder unfolds, second and third sections of the ladder can unfold until the ladder is fully opened and ready for use. When not in use, the user can actuate the remote control device to fold and lift the ladder sections above a ceiling compartment and close the ceiling compartment.

Additional features and embodiments of the present general inventive concept will be set forth in part in the description which follows and, in part, will be obvious from the description, or may be learned by practice of the general inventive concept.

Example embodiments of the present general inventive concept can be achieved by providing a remote controlled overhead ladder system including a ladder structure having at least a first section and a second section. The ladder structure can be mounted to a support structure located above an opening of the overhead surface, and can include a remote controlled lifting cable connected to the first and second sections such that upon receipt of a remote control signal, the lifting cable pivots the second section toward a front surface of the first section until the second section is oriented substantially adjacent to the front surface of the first section, at which time the lifting cable pivots the first section and the adjacent second section as a group toward the overhead surface until the ladder sections are substantially coplanar to, and above, the overhead surface.

Example embodiments of the present general inventive concept can also be achieved by providing a remote controlled overhead ladder system including a ladder structure having a first section, a second section, and a third section. The ladder structure can be mounted to a support structure located above an opening of the overhead surface, and can include a remote controlled drive apparatus including a lifting cable connected to the first and second sections such that upon receipt of a remote control signal, the lifting cable pivots a front surface of the second section toward a front surface of the first section such that a back surface of the third section concurrently pivots toward a back surface of the second section until the second and third sections are oriented substantially adjacent to the front surface of the first section, at which time the lifting cable pivots the first section and the adjacent second and third sections as a group toward the overhead surface until a back surface of the first section is oriented substantially coplanar to the overhead surface and the second and third sections are oriented above the first section.

The back surface of the first section can include a panel structure to cover the opening when the ladder structure is fully raised.

The overhead ladder system can include an operating arm connected between the support structure and the first section to support the first section with respect to the overhead surface.

The overhead ladder system can also include a shock element connected to the operating arm to inhibit pivoting movement of the first section with respect to the overhead surface until the second and third sections are oriented substantially adjacent to the front surface of the first section.

The support structure can include a boxed-frame structure oriented substantially parallel to the overhead surface such that the shock element inhibits the pivoting movement of the first section until the second and third sections are positioned to clear the boxed-frame.

The overhead ladder system can also include a spring mechanism connected between the operating arm and the support structure to assist pivoting movement of the first section and to prevent the first section from free-falling from the overhead surface.

The support structure can include a sloped-frame assembly located adjacent to an end of the first section and extending above the overhead surface at an acute angle relative to the overhead surface. The sloped-frame can include at least one step to facilitate climbing of the sloped-frame above the overhead surface.

The remote controlled drive apparatus can include a drive motor, a drive spool rotatably connected to the drive motor to lift the lifting cable when the drive spool is rotated, and a remote controlled device to actuate the drive motor to rotate the drive spool.

The remote controlled drive apparatus can also include a tension arm disposed above the overhead surface including at least one pulley connected to the lifting cable, an inner pulley connected to the second section to guide the lifting cable from the second section to the first section, a folding cable connected between the first section and the third section to assist pivoting movement of the third section, and an outer pulley connected to the second section to guide the folding cable between the first section and the third section.

The overhead ladder system can also include an emergency release assembly to disengage the remote controlled drive apparatus from the ladder structure.

Example embodiments of the present general inventive concept can also be achieved by providing a method of operating an overhead ladder system, including installing a drive apparatus above the overhead surface, connecting a lifting cable to the first and second sections and the drive apparatus, and actuating the drive apparatus via a remote control signal to raise the lifting cable such that the lifting cable pivots a front surface of the second section toward a front surface of the first section such that a back surface of the third section concurrently pivots toward a back surface of the second section until the second and third sections are oriented substantially adjacent the front surface of the first section, at which time the lifting cable pivots the first section and the adjacent second and third sections as a group toward the overhead surface until a back surface of the first section is oriented substantially coplanar to the overhead surface and the second and third sections are oriented above the first section.

BRIEF DESCRIPTION OF THE SEVERAL VIEWS OF THE DRAWINGS

The following example embodiments are representative of exemplary techniques and structures designed to carry out the objectives of the present general inventive concept, but the present general inventive concept is not limited to these example embodiments. Additional embodiments and/or features of the present general inventive concept will become more clearly understood from the following detailed description of the example embodiments read together with the accompanying drawings in which.

DETAILED DESCRIPTION

Figure 1:
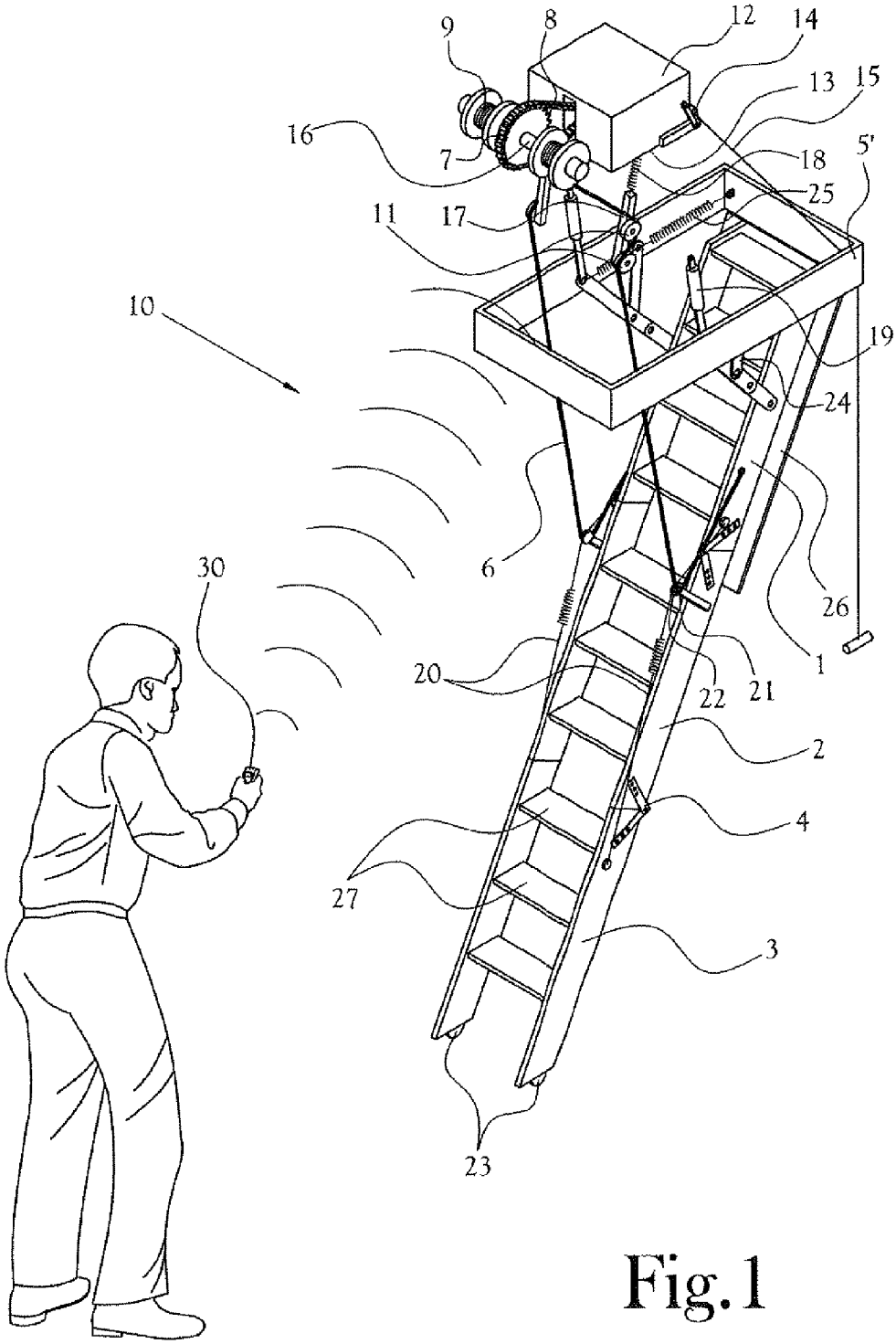
FIG. 1 is a perspective view of an overhead ladder system configured in accordance with an example embodiment of the present general inventive concept.

Reference will now be made to various embodiments of the present general inventive concept, examples of which are illustrated in the accompanying drawings, wherein like reference numerals refer to like elements throughout. The following description of the various embodiments is merely exemplary in nature and is in no way intended to limit the present general inventive concept, its application, or uses. The example embodiments are merely described below in order to explain the present general inventive concept by referring to the figures. It is noted that in the accompanying drawings and illustrations, the sizes and relative sizes, shapes, and qualities of lines, entities, and regions may be exaggerated for clarity and/or convenience of illustration.

It is also noted that throughout the following description, spatially relative terms, such as "up," "down," "right," "left," "beneath," "below," "lower," "above," "upper" and the like, may be used for ease of description to describe one element or feature's relationship to another element(s) or feature(s) as illustrated in the figures. It will be understood, however, that these spatially relative terms are intended to encompass different orientations of the device in use or operation in addition to the orientation depicted in the figures, and are provided for convenience of description only with reference to the figures. For example, if the device in the figures is turned over or rotated, elements described as "below" or "beneath" other elements or features would then be oriented "above" the other elements or features. Thus, the exemplary term "below" can encompass both an orientation of above and below. The device may be otherwise oriented (rotated 90 degrees or at other orientations) and the spatially relative descriptors used herein interpreted accordingly.

FIG. 1 is a perspective view of a motorized overhead ladder system configured in accordance with an example embodiment of the present general inventive concept. The operating environment of FIG. 1 includes a ladder apparatus generally indicated by reference number 10. The ladder structure 10 is installable within a ceiling, attic, or storage area above the ceiling, as illustrated in FIG. 1. It is also possible to implement the ladder apparatus in other types of structures such as mezzanines, elevated walkways, roof access areas, basements, fire escapes, stairwells, and the like, without departing from the broader concepts and techniques of the present general inventive concept.

Referring to FIG. 1, the ladder structure 10 includes a plurality of sectional members 1, 2, and 3, which can be joined together end-to-end by suitable pivoting bracket structures 4, enabling the sectional members to pivot with respect to one another. As illustrated in FIG. 1, when the ladder structure 10 is in the open position, the sectional members 1, 2, and 3 define a substantially linear climbing structure having a plurality of rungs 27 to facilitate climbing of the ladder to access an attic or other elevated-type structure above the ceiling 180. In one embodiment, the rungs 27 may include serrated treads (not illustrated) to facilitate gripping on the rungs.

As illustrated in FIG. 1, the foldable attic ladder structure 10 can be installed above a ceiling structure 180. In one embodiment, the ladder structure 10 can be supported from the ceiling surface so the ladder can be lowered to retract downward, or unfold, from the support structure by way of a boxed-frame 5' support structure. The ladder sections 1, 2, 3, can be selectively raised and lowered under the control of a drive motor 12. The drive motor 12 can be actuated by a remote controlled device 30, as illustrated in FIG. 1. This embodiment enables a user to open the ladder section from a remote location, which may be substantially beyond the user's reach, to raise and/or lower the ladder, enabling the user to activate a substantially linear ladder structure, climb the rungs 27, and access storage areas or other elevated attic or walkway structures which may be beyond the reach of conventional pull-down ladders.

In some embodiments, as mentioned previously, the support structure may take the form of a boxed frame 5', but the present general inventive concept is not limited to such shape. For example, referring to FIGS. 2 to 6, it is also possible to configure the frame as a sloped frame 5, described in more detail below. It is important to note, however, that the support structure could be configured in a variety of shapes, sizes, and angles, without departing from the broader scope and spirit of the present general inventive concept.

Figure 5:
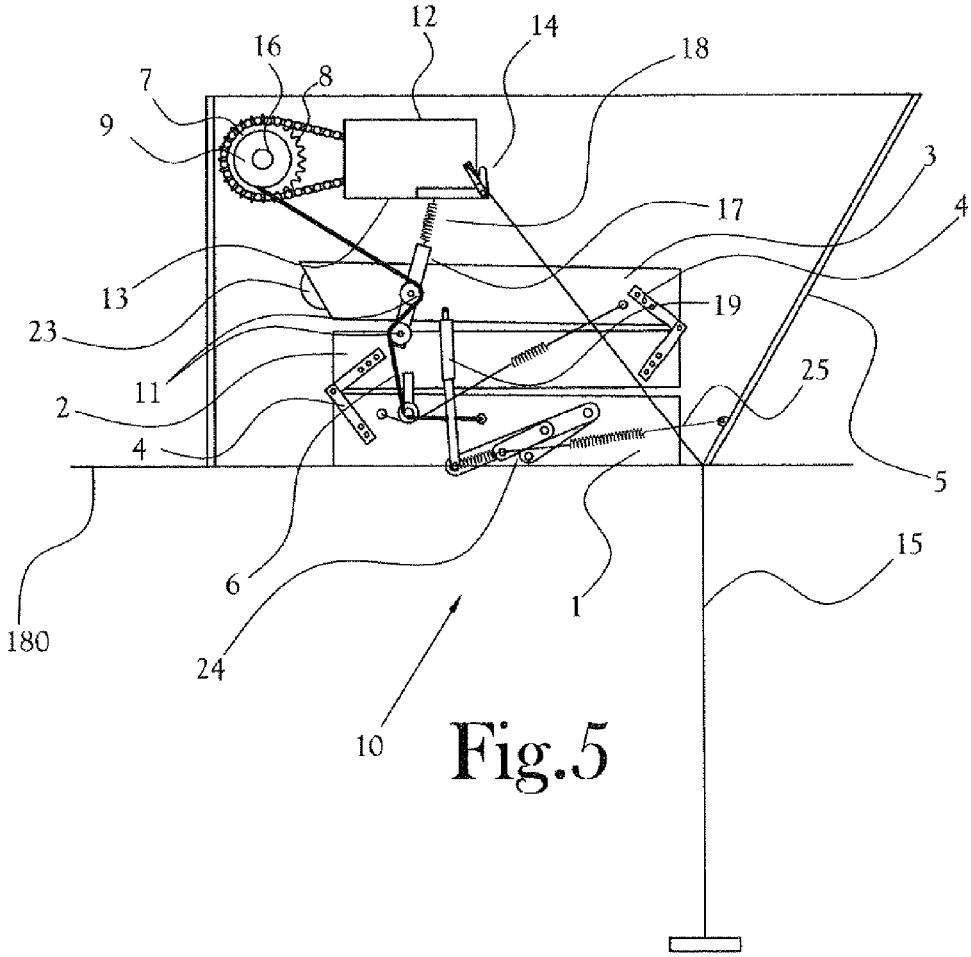
FIG. 5 is a side view of the overhead ladder system illustrating the ladder sections located above the overhead surface after being raised according to an example embodiment of the present general inventive concept.
Figure 6:
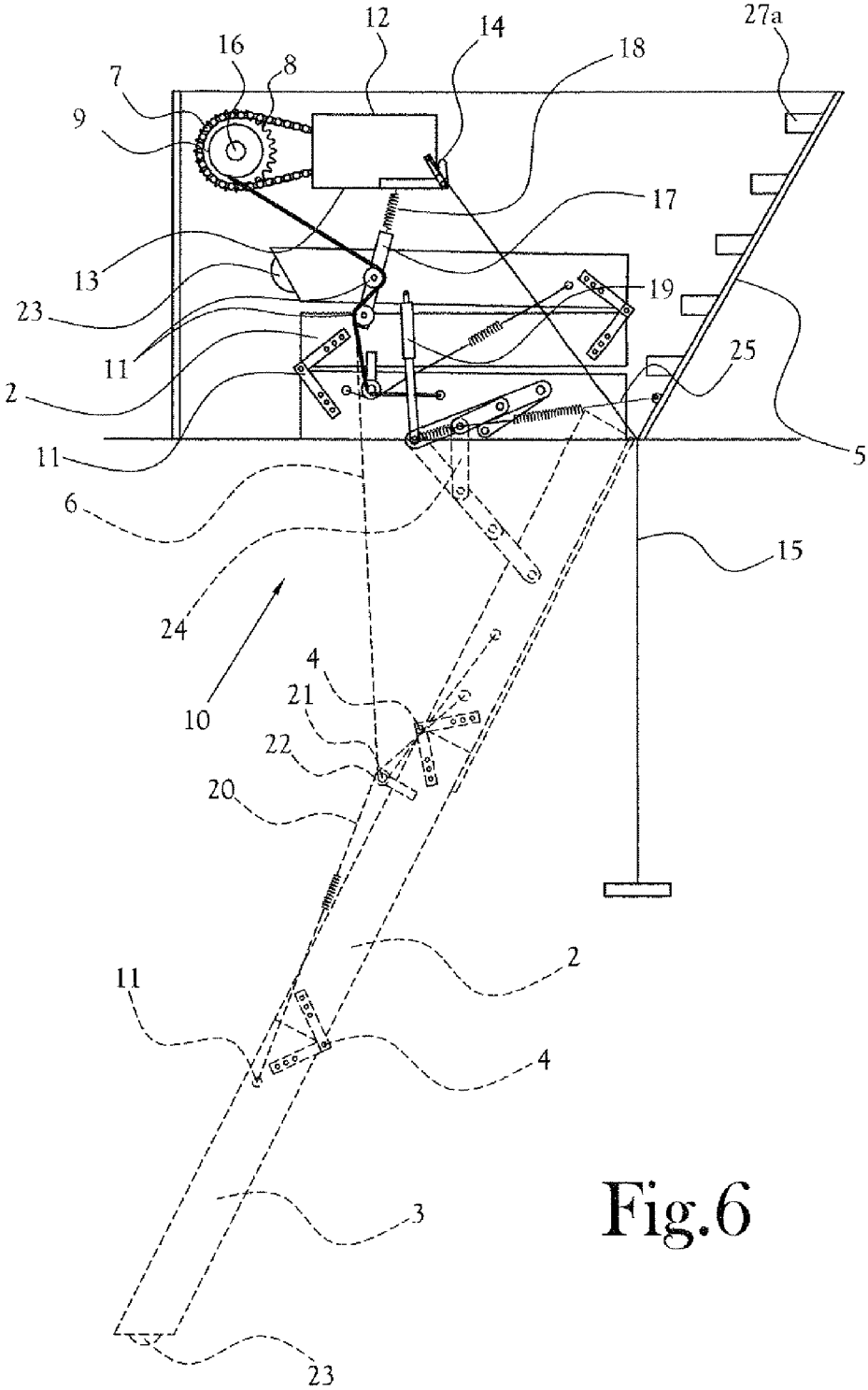
FIG. 6 is a side conceptual view of an overhead ladder system configured in accordance with an example embodiment of the present general inventive concept.

Referring to FIG. 5, in particular, the back surface of a top sectional member 1 can include a door panel 26 pivotally connected to a back surface of the top section 1 to cover an opening in the ceiling or other elevated structure when the ladder 10 is not in use (see, e.g., FIG. 5).

Referring back to FIG. 1, example embodiments of the present general inventive concept can include a motor release assembly 14 and release cable 15 to enable an operator to manually open the door panel 26 and unfold the ladder sections 1, 2, 3, for example, in the event of a power failure. In such case, a spring mechanism 25 can be provided to prevent the ladder structure 10, in particular the top section and sections stacked above the top section, from free falling when the door panel 26 is opened manually, for example.

In the example embodiments, the ladder structure 10 is generally described in terms of having three sectional members: a top stair section 1, a middle stair section 2, and a bottom stair section 3. However, those skilled in the art will appreciate that the present general inventive concept is not limited to any particular number of sectional members, and it is possible that more or less sectional members could be used without departing from the broader scope and spirit of the present general inventive concept.

In the illustrated embodiments, for example FIG. 1, it is apparent that when the ladder 10 is in the unfolded or lowered position, the individual stair sections 1, 2, 3 are arranged in an end-to-end manner to provide a substantially linear ladder structure when the sectional members are extended.

FIGS. 2-6 illustrate exemplary operations of the motorized attic ladder according to another example embodiment of the present general inventive concept. In this embodiment, the ladder structure 10 can be supported above the ceiling 180 by a sloped-frame support structure 5 which extends upwardly at an acute angle above the ceiling into the attic structure or other storage area. The sloped-frame 5 can also include optional rungs 27*a* or steps to facilitate climbing of the frame to access regions contained in the area above the ceiling surface 180. Additional shapes and configurations of the frame 5 could be used without departing from the broader scope and spirit of the present general inventive concept.

Referring to FIGS. 2-6, a drive motor 12 can be positioned on a motor shelf 13 above the ceiling to drive one or more lifting cables 6 under the assistance of a chain 7 and sprocket 8 arrangement. In these example embodiments, the sprocket 8 is positioned between a pair of cable spools 9 on a drive shaft 16 to rotate the spools 9 to lift or lower the cables 6, e.g., by winding or unwinding the cables 6, in response to actuation of the drive motor 12. Other configurations could also be implemented using sound engineering judgment given the present teachings and disclosure of the present general inventive concept.

Figure 2:
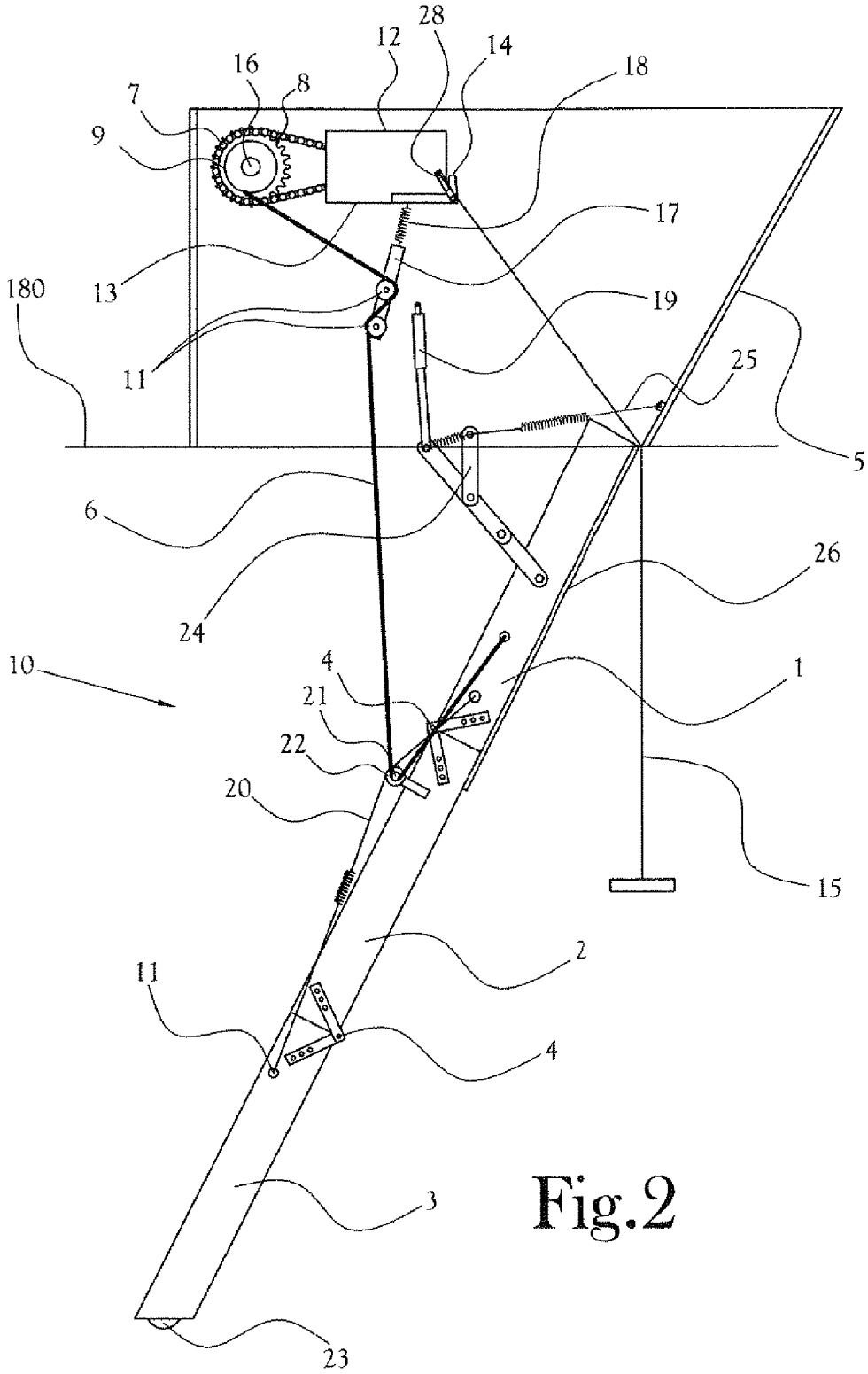
FIG. 2 is a side view of an overhead ladder system configured in accordance with another example embodiment of the present general inventive concept.

Referring to FIG. 2, we will refer to the ladder structure 10 as being in the open, or lowered, position. In this figure, when the motor is actuated by the remote control device 30 (FIG. 1), the chain 7 is made to rotate, which in turn rotates the sprocket 8 and spools 9 about the drive shaft 16, with results being that the lifting cable 6 is lifted, or retracted, facilitating lifting and folding of the ladder sections 1, 2, and 3, as illustrated in FIGS. 2-5.

Figure 3:
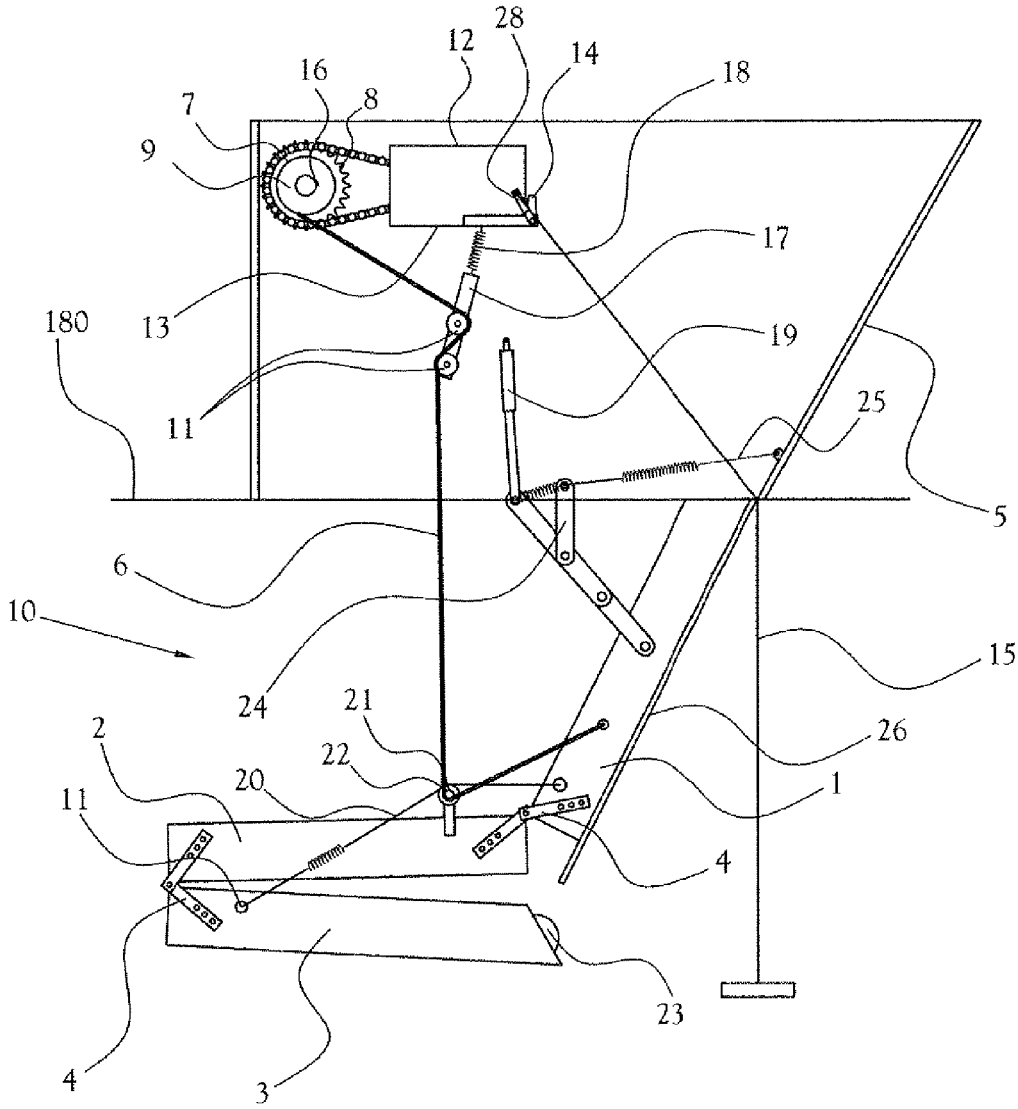
FIG. 3 is a side view of the overhead ladder system of FIG. 2 in a partially retracted position according to an example embodiment of the present general inventive concept.
Figure 4:
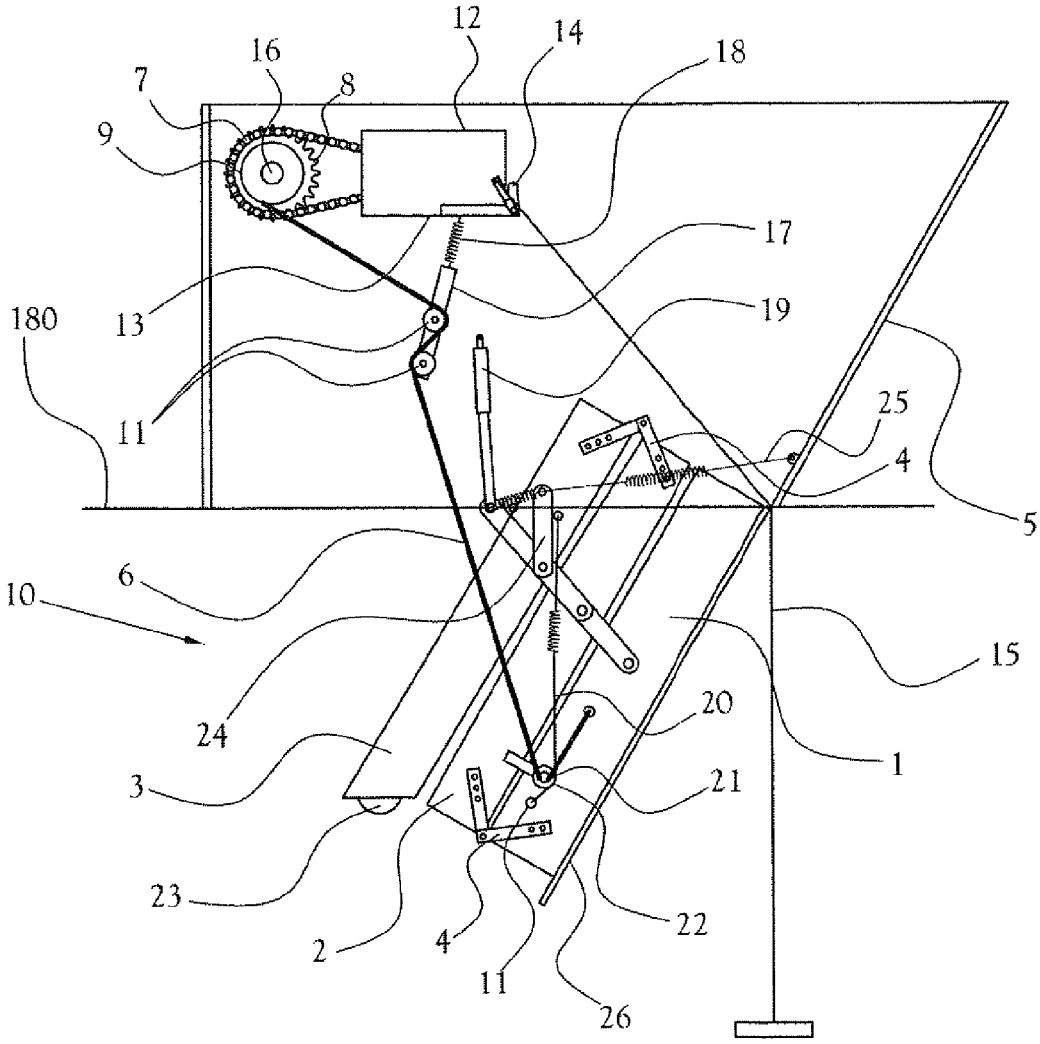
FIG. 4 is a side view of the overhead ladder system illustrating the ladder sections being adjacent to, or stacked, one above the other, prior to being lifted above the overhead surface according to an example embodiment of the present general inventive concept.

For example, referring to FIGS. 2 and 3, one end of the lifting cable 6 can be attached to the top stair section 1 via an inner pulley 21, which in turn is connected to the middle stair section 2. As illustrated in FIG. 3, as the spool 9 is turned and the lifting cable 6 is retracted by the drive-motor apparatus, the lifting cable 6 lifts the middle stair section 2 upwardly owing to the lifting forces translated to the middle stair section 2 via the inner pulley 21 and cable 6, thus pivoting a front surface of the middle section 2 toward a front surface of the top section 1 such that a back surface of the bottom section 3 concurrently pivots toward a back surface of the middle section until the middle and bottom sections are oriented substantially adjacent to, or stacked one above the other, relative to the front surface of the top section. At this time, the lifting cable 6 can pivot the top section 1 and the adjacent middle and bottom sections 2, 3 as a group toward the overhead surface 180 until a back surface of the top section is oriented substantially coplanar to the overhead surface 180 and the middle and bottom sections are oriented above the top section and overhead surface, as illustrated in FIG. 5.

In the example embodiment of FIG. 3, a folding cable 20 can be provided between the bottom stair section 3 and the top stair section 1 via an outer pulley 22. In this example embodiment, the outer pulley 22 can be positioned adjacent to the inner pulley 21 such that as the middle stair section 2 is being lifted, gravitational forces cause the bottom stair section 3 to pivot with respect to the middle stair section 2 such that the bottom stair section 3 starts to fold underneath the middle stair section 2 as illustrated in FIG. 3. Here, tension forces from the folding cable 20 assist the bottom stair section 3 to remain folded underneath the middle stair section 2 as the middle stair section 2 is being lifted. During the lowering process, the folding cable 20 can also enable the bottom section 3 to kick-out into place to align with the other stair sections as the ladder is lowered to the ground. The present general inventive concept is not limited to any particular attachment points for the folding cable 20. For example, it is possible to attach the folding cable 20 between the bottom and middle stair sections to achieve the desired results without departing from the broader scope and purposes of the present general inventive concept.

One or more wheels 23 can be provided on a bottom surface of the bottom stair section 3 to assist movement of the bottom stair section 3 against a floor or ground surface (not illustrated) upon actuation of the drive motor.

It is possible that the remote controlled device 30 can include various controls and/or switches to communicate suitable signals to the drive motor 12 to control the speed at which spools 9 are rotated, thus enabling the operator to control the speed at which the ladder 10 is opened and closed. The direction of the spools can also be controlled to selectively raise and lower the ladder structures in response to the remote signal. The drive motor 12 can be configured to respond to remote signals from the remote control device 30 via a wired or wireless connection to selectively open and close the ladder and/or control the speed of opening and closing of the ladder based on operator inputs from the remote control device 30.

Referring to FIGS. 2-5, the motorized ladder system can include an arrangement of components including a set of upper pulleys 11, a cable tension arm 17, and a cable tension spring 18 configured to translate and direct lifting forces to the ladder sections 1, 2, and 3 via the lifting cable 6. As illustrated, these components work in cooperation with the inner and outer pulleys 21, 22, and folding cable 20 to facilitate lifting and folding movement of the ladder sections in response to by the drive motor 12, for example to lift, lower, fold, unfold, open, and close the ladder sections 1, 2, and 3.

As illustrated in FIGS. 2-5, the lifting arrangement can include an operating arm 24 to support the upper stair section 1 with respect to the ceiling structure 180. A gas shock element 19 can be connected to one end section of the operating arm 24, and a spring 25 can be connected between the ends of the operating arm 24 and the sloped-frame 5 to assist the lifting forces for lifting and closing of the ladder sections 1, 2, 3 above the ceiling 180 as illustrated in FIG. 5. In some embodiments, the gas shock 19 can be configured to provide a resistive force to delay closing of the door panel 26 long enough for the sections to fully fold together.

For example, in the case of the box-frame embodiment of FIG. 1, it is possible for the gas shock 19 to apply resistive pressure against the top stair section 1 during closing to keep the top stair section 1 in place, i.e., delay closing of the top stair section 1, while the middle and bottom sections 2, 3 clear the box frame 5' for closing.

In the example embodiments, there is illustrated a motorized sectional overhead attic ladder system operable in a ceiling, attic, mezzanine, elevated walkway, roof access area, basement, fire escape, stairwell, or other elevated structure. The system can remotely open and close the ladder structure upon actuation of a remote control device, thus enabling automatic opening, closing, folding, and unfolding operations of the sectional ladder for a variety of applications. For example, when the ladder is not in use, an operator can actuate the remote control device to fold and lift the ladder sections into the ceiling compartment and close the panel of the ceiling access for convenient storage.

It is noted that the simplified diagrams and drawings do not illustrate all the various connections and assemblies of the various components, however, those skilled in the art will understand how to implement such connections and assemblies, based on the illustrated components, figures, and descriptions provided herein. It is also noted that numerous variations, modifications, and additional embodiments are possible, and accordingly, all such variations, modifications, and embodiments are to be regarded as being within the spirit and scope of the present general inventive concept. For example, regardless of the content of any portion of this application, unless clearly specified to the contrary in the description or claims, there is no requirement for the inclusion in any claim herein or of any application claiming priority hereto of any particular described or illustrated activity or element, any particular sequence of such activities, or any particular interrelationship of such elements.

Thus, while the present general inventive concept has been illustrated by description of several example embodiments, it is not the intention of the applicant to restrict or in any way limit the scope of the general inventive concept to such descriptions and illustrations. Instead, the descriptions, drawings, and claims herein are to be regarded as illustrative in nature, and not as restrictive, and additional embodiments will readily appear to those skilled in the art upon reading the above description and drawings.

What is claimed is:

1. An overhead ladder system, comprising:

a ladder structure having a first section, a second section, and a third section;

a support structure mounted to an overhead surface to support the ladder structure from an opening of the overhead surface;

a remote controlled drive apparatus comprising a lifting cable connected to the first and second sections such that upon receipt of a remote control signal, the lifting cable pivots a front surface of the second section toward a front surface of the first section such that a back surface of the third section concurrently pivots toward a back surface of the second section until the second and third sections are oriented substantially adjacent to the front surface of the first section, at which time the lifting cable pivots the first section and the adjacent second and third sections as a group toward the overhead surface until a back surface of the first section is oriented substantially coplanar to the overhead surface and the second and third sections are oriented above the first section, wherein the remote controlled drive apparatus comprises:

a drive motor;

a drive spool rotatably connected to the drive motor to lift the lifting cable when the drive spool is rotated; and a remote controlled device to actuate the drive motor to rotate the drive spool, wherein the remote controlled drive apparatus further comprises:

a tension arm disposed above the overhead surface and including at least one pulley connected to the lifting cable;

an inner pulley connected to the second section to guide the lifting cable from the second section to the first section;

a folding cable connected between the first or second section and the third section to assist pivoting movement of the third section; and an outer pulley connected to the second section to guide the folding cable when the folding cable is connected between the first section and the third section.

2. The overhead ladder system of claim 1, further comprising an emergency release assembly to disengage the remote controlled drive apparatus from the ladder structure.

3. The overhead ladder system of claim 2, further comprising at least one wheel connected to a bottom surface of the third section to assist movement of the third section relative to a ground surface.

4. In an overhead ladder system having a ladder structure defining a first section, a second section, and a third section, including a support structure mounted to an overhead surface to support the ladder structure from an opening of the overhead surface, a method of operating an overhead ladder system comprising:

installing a drive apparatus above the overhead surface;

connecting a lifting cable to the first and second sections and the drive apparatus; and actuating the drive apparatus via a remote control signal to raise the lifting cable such that the lifting cable pivots a front surface of the second section toward a front surface of the first section such that a back surface of the third section concurrently pivots toward a back surface of the second section until the second and third sections are oriented substantially adjacent the front surface of the first section, at which time the lifting cable pivots the first section and the adjacent second and third sections as a group toward the overhead surface until a back surface of the first section is oriented substantially coplanar to the overhead surface and the second and third sections are oriented above the first section, further comprising:

installing an inner pulley to the second section to guide the lifting cable from the second section to the first section;

connecting a folding cable between the first or second section and the third section to assist pivoting movement of the third section; and installing an outer pulley to the second section to guide the folding cable when the folding cable is connected between the first section and the third section.

* * * * *